US012544816B2

(12) United States Patent
White et al.

(10) Patent No.: US 12,544,816 B2
(45) Date of Patent: Feb. 10, 2026

(54) TENSION REDUCTION PAINTLESS DENT REMOVAL SYSTEM, TOOL, AND METHOD

(71) Applicant: EHC INC., Oklahoma City, OK (US)

(72) Inventors: Chris White, Oklahoma City, OK (US); Reggie Ayers, Oklahoma City, OK (US); Chris Lawson, Oklahoma City, OK (US); Kevin Andrews, Oklahoma City, OK (US)

( * ) Notice: Subject to any disclaimer, the term of this patent is extended or adjusted under 35 U.S.C. 154(b) by 277 days.

(21) Appl. No.: 18/388,593

(22) Filed: Nov. 10, 2023

(65) Prior Publication Data

US 2024/0157423 A1 May 16, 2024

Related U.S. Application Data

(60) Provisional application No. 63/424,628, filed on Nov. 11, 2022.

(51) Int. Cl.
*B21D 1/06* (2006.01)

(52) U.S. Cl.
CPC ..... *B21D 1/06* (2013.01)

(58) Field of Classification Search
CPC . B21D 1/06; B21D 1/065; B21D 1/10; B21D 1/12; Y10S 72/705
See application file for complete search history.

(56) References Cited

U.S. PATENT DOCUMENTS

| | | | | |
|---|---|---|---|---|
| 3,395,561 | A * | 8/1968 | Lague | B21D 1/14 72/308 |
| 5,479,804 | A | 1/1996 | Cook | |
| 6,014,885 | A | 1/2000 | Griffaton | |
| 6,722,179 | B1 | 4/2004 | Ventura | |
| 6,957,561 | B1 | 10/2005 | Contreras | |
| 6,964,186 | B1 * | 11/2005 | Strasser | B21D 1/06 72/457 |
| 8,516,875 | B1 * | 8/2013 | Chan | B21D 1/06 72/457 |
| 9,669,442 | B1 | 6/2017 | Alvarez | |
| 9,757,782 | B2 | 9/2017 | Wilkinson | |
| 9,868,143 | B2 | 1/2018 | Zimmerman | |
| 9,889,483 | B1 | 2/2018 | Allen | |
| 10,245,629 | B1 | 4/2019 | Skelton et al. | |
| 10,252,308 | B2 | 4/2019 | Hummert | |
| 2005/0076700 | A1 * | 4/2005 | Venalainen | B21D 1/06 72/705 |

* cited by examiner

*Primary Examiner* — Teresa M Ekiert
(74) *Attorney, Agent, or Firm* — D. Ward Hobson

(57) ABSTRACT

An improved paintless dent removal tool and method of use is disclosed. The paintless dent removal tool generally includes a hand-held jack member having a grip mechanism, a sleeve member, a rod member, a slide bar, a first tension adjustment knob member, a second tension adjustment knob member, a first foot member, and a second foot member. In use, the first tension reduction knob member and the second tension reduction knob member are manually adjusted to the pull the first foot member and the second foot member outward, thereby reducing tension on the surface of the vehicle surrounding the area of the dent. Simultaneously, the grip mechanism is pulled by a user to manually raise the rod member upward to pull out and remove the dent on the vehicle surface.

6 Claims, 6 Drawing Sheets

TENSION REDUCTION PAINTLESS DENT REMOVAL SYSTEM, TOOL, AND METHOD

CROSS REFERENCE TO RELATED APPLICATIONS

This application claims priority to U.S. Provisional Application No. 63/424,628 filed on Nov. 11, 2022, which is expressly incorporated herein by reference in its entirety.

FIELD OF INVENTION

The invention is in the technical field of paintless dent removal systems, tools, and methods which are used to "pull-out" dents in the outer body of a vehicle, such as an automobile, aircraft, motorcycle, and the like, for example.

BACKGROUND

Advancements in construction methods and materials have resulted in lighter and stronger vehicle bodies for automobiles, aircrafts, motorcycles and the like. However, such improved vehicle bodies are often increasingly prone to dents, dings and various other body deformations. Such damage may be caused by, for example, automobile accidents or debris striking the outer surface of the vehicle body. Removing such dents, dings and deformations can be difficult, laborious and time consuming, even when using traditional paintless dent removal tools and processes.

In general, paintless dent removal is the process of removing dents from the body of a vehicle body without repainting the vehicle. Thus, saving the owner of the vehicle time and money by avoiding the cost and expense of repainting the vehicle. Traditionally, in paintless dent removal, many removal shops utilize the flexibility and durability of the outer surface of the vehicle body to reach into vehicle body compartments to "push-out" a dent from the inside outward or "pull-out" a dent from the outside of the vehicle body. Once the dent is pushed or pulled out, there is also a need to partially "knock-down" or flatten the dent to smooth-out the outer surface of the vehicle body to completely remove the dent.

Traditionally, dent removal shops have used a variety of tools to help assist a user with the paintless dent removal process, including tools designed to assist a user with the "push-out" and "pull-out" process and tools designed to assist a user with the "knock-down" process, far example. Unfortunately, however, such traditional tools are inefficiently configured, difficult to use and difficult to control. Thus, decreasing their usefulness and increasing the overall cost of the paintless dent removal process. To that end, it would be advantageous to provide an improved paintless dent removal tool, system and method configured to more efficiently "pull-out" dents from the surface of a vehicle body, utilizing tension reduction, to increase the effectiveness and reduce the cost of the paintless dent removal process.

SUMMARY OF THE INVENTION

The inventive concepts disclosed herein are generally directed to a modular tension reduction paintless dent removal system, tool, and method of use. The tension reduction system, tool, and method includes a mechanism for pulling upward a glue tab that is affixed to a dent on a vehicle, while simultaneously pulling the area surrounding the dent outward, so as to reduce the tension on the surface of the vehicle surrounding the dent, thereby enabling the upward pull to more effectively and efficiently "pull-out" and remove the dent on the vehicle surface. By reducing the tension on the surface of the vehicle surrounding the dent while pulling the dent upward, the system, tool and method is able to pull-out larger and deeper dents with less effort and using only a single system, tool and method. Thereby, providing significant advantages over traditional paintless dent repair tools.

For example, because traditional paintless dent repair tools are specific to a particular size and shape dent and a particular type of action (i.e., a pulling tool or a knock-down tool), multiple different tools would typically be required to attempt to simultaneously reduce tension on the area surrounding the dent while simultaneously pulling the dent upward and out. The improved tension reduction paintless dent removal system and tool combines both actions in a single modular, adjustable and modifiable tool and system. Thereby providing significant cost savings, efficiency advantages, and increasing the overall usefulness and effectiveness of the tool. Further, because the components of the improved tension reduction paintless dent removal system and tool are modular, one part may be substituted or replaced with another part without having to replace the entire system or tool. Thereby providing additional advantages over simply combining separate traditional stand-alone tools to attempt to reduce tension and pull out a dent on the surface of a vehicle. Moreover, the combination of the tension reduction action with the upward pulling action in a single tool permits the improved system and tool to pull out larger and deeper dents than traditional stand-alone tools and with less effort.

In some embodiments, the paintless dent removal tool includes a detachably removable hand-held jack member. The jack member having a top, a bottom, an internal chamber, a rotation mechanism, and a grip mechanism for manual operation of the jack member. The paintless dent removal tool also includes a detachably removable sleeve member. The sleeve member having a top, a bottom, a rotation mechanism, an opening, and an internal chamber. The top of the sleeve member detachably connected to the bottom of the jack member such that the jack member is capable of rotating about the sleeve member. The paintless dent removal tool also includes a detachably removable rod member. The rod member positioned within a portion of the internal chamber of the jack member and a portion of the internal chamber of the sleeve member. The rod member having a top end detachably connected to the jack member and a bottom end extending out from the bottom of the sleeve member. The paintless dent removal tool also includes a detachably removable slide bar. The slide bar having a first end, a second end, and an opening extending between the first end and the second end. The slide bar slidably connected to the sleeve member, wherein the sleeve member is slidable along the slide bar between the first end of the slide bar and the second end of the slide bar. The rod member extends through the opening of the slide bar.

The paintless dent removal tool also includes a first tension adjustment knob member detachably connected to the first end of the slide bar and a second tension adjustment knob member detachably connected to the second end of the slide bar. The paintless dent removal tool further includes a first foot member having a top and a bottom. The top of the first foot member detachably connected to the first end of the slide bar and to the first tension adjustment knob member. The paintless dent removal tool includes a second foot member having a top and a bottom. The top of the second foot member detachably connected to the second end of the slide bar and to the second tension adjustment knob member. Wherein, the first tension reduction knob member and the second tension reduction knob member are configured to be manually adjusted to pull the first foot member and the second foot member outward, thereby reducing tension on the surface of the vehicle surrounding the area of the dent. Simultaneously, the grip mechanism is configured to be pulled to manually raise the rod member upward to pull out and remove the dent on the vehicle surface.

In some embodiments, the paintless dent removal tool further includes a first glue tab detachably connected to the bottom end of the rod member and configured to be attached to the surface of a vehicle. The paintless dent removal tool may also include a second glue tab detachably connected to the bottom of the first foot member and configured to attached to the surface of the vehicle. The paintless dent removal tool may also include a third glue tab detachably connected to the bottom of the second foot member and configured to be attached to the surface of the vehicle. In some embodiments, the paintless dent removal tool may also include a tab connector detachably connected to the bottom end of the rod member.

A method of removing a dent from a vehicle is also disclosed. The method includes the step of providing a paintless dent removal tool for removing a dent from a vehicle. The paintless dent removal tool including a detachably removable hand-held jack member. The jack member having a top, a bottom, an internal chamber, a rotation mechanism, and a grip mechanism for manual operation of the jack member. A detachably removable sleeve member. The sleeve member having a top, a bottom, a rotation mechanism, an opening, and an internal chamber. The top of the sleeve member is detachably connected to the bottom of the jack member such that the jack member is capable of rotating about the sleeve member, A detachably removable rod member positioned within a portion of the internal chamber of the jack member and a portion of the internal chamber of the sleeve member. The rod member having a top end detachably connected to the jack member and a bottom end extending out from the bottom of the sleeve member. A detachably removable slide bar having a first end, a second end, and an opening extending between the first end and the second end. The slide bar slidably connected to the sleeve member. Wherein the sleeve member is slidable along the slide bar between the first end of the slide bar and the second end of the slide bar. Wherein the rod member extends through the opening of the slide bar. A first tension adjustment knob member detachably connected to the first end of the slide bar. A second tension adjustment knob member detachably connected to the second end of the slide bar. A first foot member having a top and a bottom. The top of the first foot member detachably connected to the first end of the slide bar and to the first tension adjustment knob member. A second foot member having a top and a bottom. The top of the second foot member detachably connected to the second end of the slide bar and to the second tension adjustment knob member.

The method further includes the step of positioning the paintless dent removal tool on the surface of a vehicle such that the dent is positioned between the first foot member and the second foot member and the jack member. The sleeve member and rod member are positioned directly above the dent. The method further includes the steps of affixing a first glue tab to the bottom end of the rod member and to the surface of the vehicle; affixing a second glue tab to the bottom of the first foot member and to the surface of the vehicle; and affixing a third glue tab to the bottom of the second foot member and to the surface of the vehicle. The method further includes the step of: adjusting the first tension reduction knob member and the second tension reduction knob member to pull the first foot member and the second foot member outward, thereby reducing tension on the surface of the vehicle surrounding the area of the dent. The method further includes the step of pulling the grip mechanism to manually raise the rod member upward to pull out and remove the dent on the vehicle surface.

The combination of the tension reduction components with the upward pulling components of the disclosed and claimed invention in single easy to use tool provides unexpected strength and efficiency and is an improvement over traditional paintless dent removal tools. Moreover, because the various components of the improved paintless dent removal tool are configured to be adjustable, replaceable, and modifiable, a single tool may be used with a variety of different sized and shaped dents. Thus, providing significant advantages and unexpected results over traditional paintless dent removal tools. It is to such an improved paintless dent removal system, tools and to methods of using thereof that exemplary embodiments of the inventive concepts disclosed and claimed herein are directed.

BRIEF DESCRIPTION OF THE SEVERAL VIEWS OF THE DRAWINGS

Like reference numerals in the figures represent and refer to the same or similar element or function. Implementations of the disclosure may be better understood when consideration is given to the following detailed description thereof. Such description makes reference to the annexed pictorial illustrations, schematics, graphs, drawings, and appendices. In the drawings.

DETAILED DESCRIPTION OF EXEMPLARY EMBODIMENTS

Figure 1:
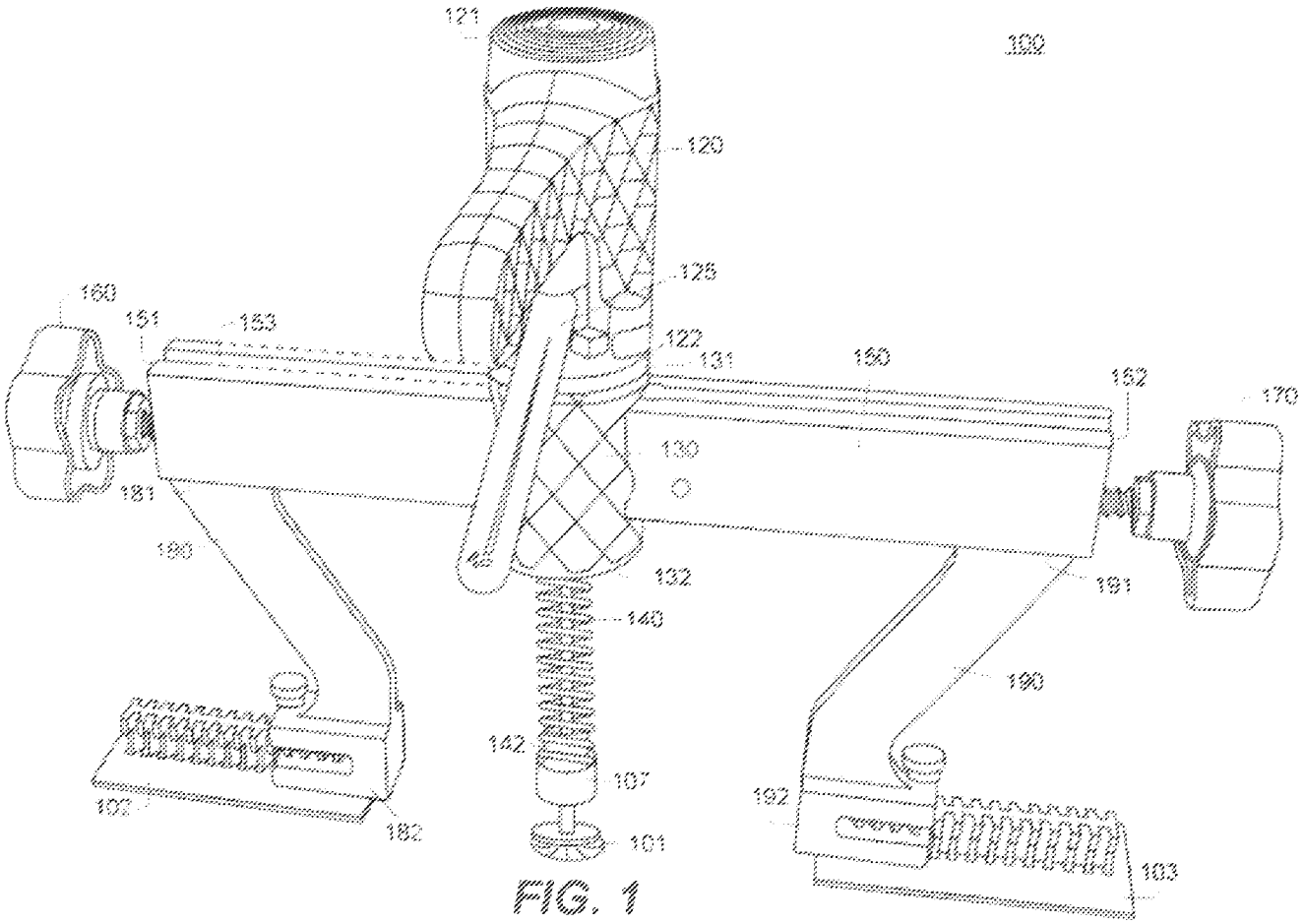
FIG. 1 is a front perspective view of the pointless dent removal tool (100) in accordance with the inventive concepts disclosed herein.

Before explaining at least one embodiment of the inventive concepts disclosed herein in detail, it is to be understood that the inventive concepts are not limited in their application to the details of construction and the arrangements of the components or steps or methodologies set forth in the following description or illustrated in the drawings. The inventive concepts disclosed herein are capable of other embodiments or of being practiced or carried out in various ways. Also, it is to be understood that the phraseology and terminology employed herein is for the purpose of description and should not be regarded as limiting the inventive concepts claimed herein in any way.

In the following detailed description of embodiments of the inventive concepts, numerous specific details are set forth in order to provide a more thorough understanding of the inventive concepts. However, it will be apparent to one of ordinary skill in the art that the inventive concepts within the disclosure may be practiced without these specific details. In other instances, well-known features have not been described in detail to avoid unnecessarily complicating the instant disclosure.

As used herein, the terms "comprises," "comprising," "includes," "including," "has," "having," or any other variation thereof, are intended to cover a non-exclusive inclusion. For example, a process, method, article, or apparatus that comprises a list of elements is not necessarily limited to only those elements but may include other elements not expressly listed.

Further, unless expressly stated to the contrary, "or" refers to an inclusive or and not to an exclusive or. For example, a condition A or B is satisfied by anyone of the following: A is true (or present) and B is false (or not present), A is false (or not present) and B is true (or present), and both A and B are true (or present).

In addition, use of the "a" or "an" are employed to describe elements and components of the embodiments herein. This is done merely for convenience and to give a general sense of the inventive concepts. This description should be read to include one or at least one and the singular also includes the plural unless it is obvious that it is meant otherwise.

Finally, as used herein any reference to "one embodiment" or "an embodiment" means that a particular element, feature, structure, or characteristic described in connection with the embodiment is included in at least one embodiment. The appearances of the phrase "in one embodiment" in various places in the specification are not necessarily all referring to the same embodiment.

Figure 2:
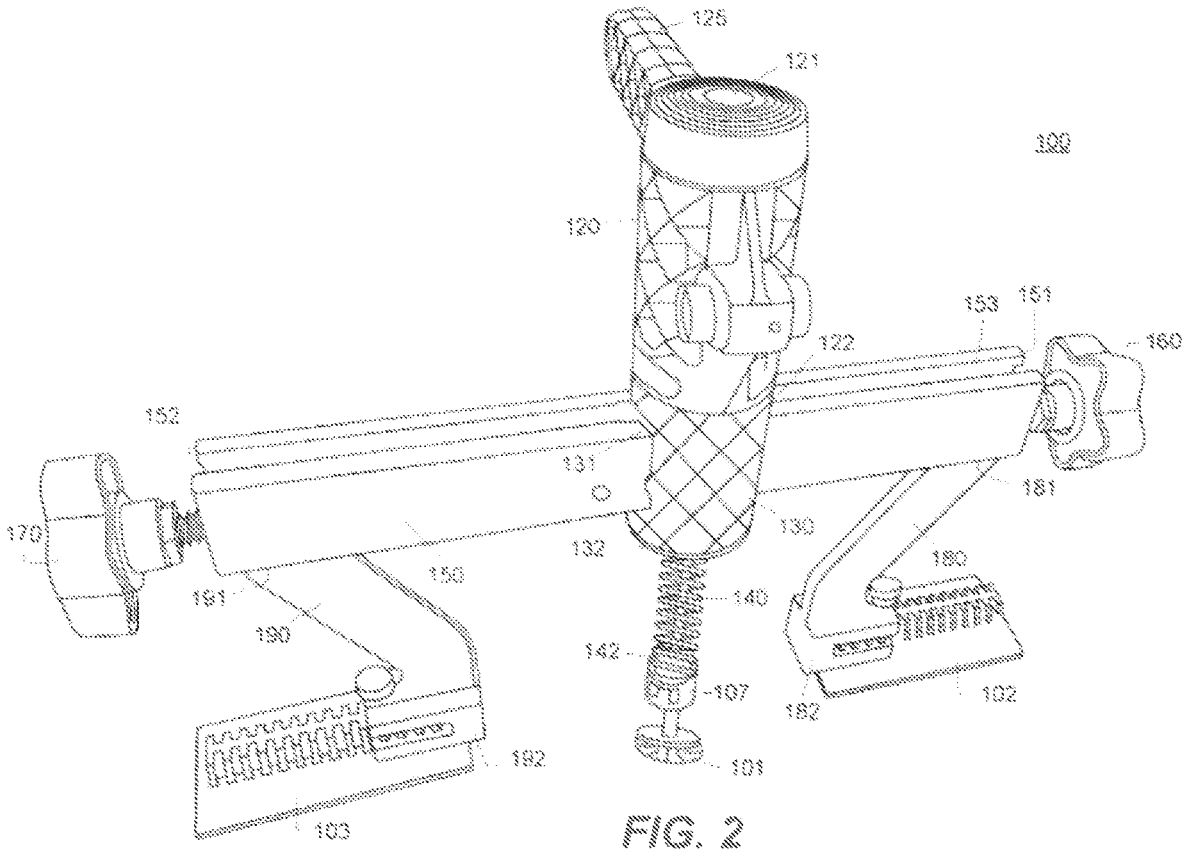
FIG. 2 is a back perspective view of the pointless dent removal tool (100) in accordance with the inventive concepts disclosed herein.
Figure 3:
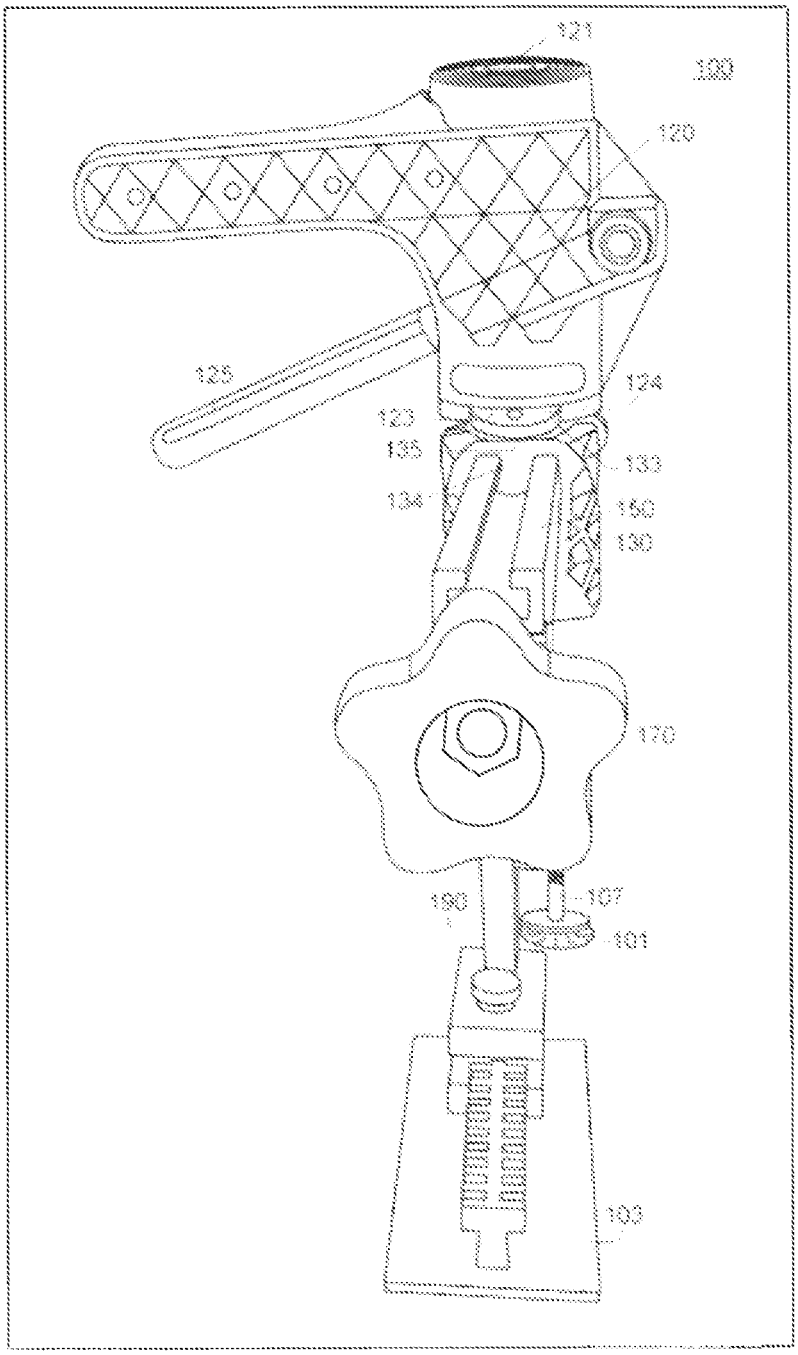
FIG. 3 is a side perspective view of the pointless dent removal tool (100) in accordance with the inventive concepts disclosed herein.
Figure 4:
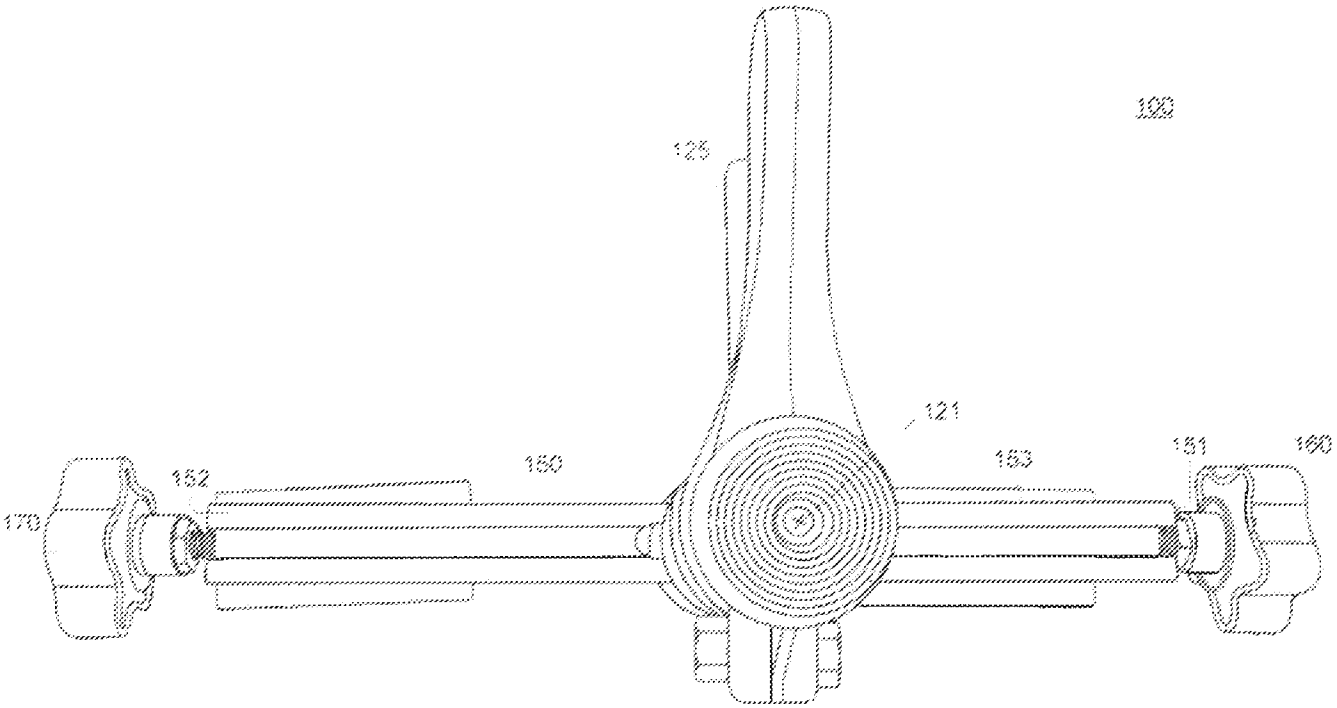
FIG. 4 is a top perspective view of the pointless dent removal tool (100) accordance with the inventive concepts disclosed herein.
Figure 5:
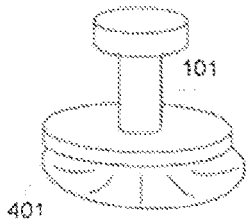
FIG. 5 is a perspective view of a glue tab (101) in accordance with the inventive concepts disclosed herein.
Figure 6:
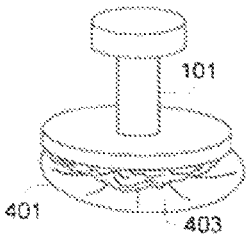
FIG. 6 is a perspective view of a glue tab (101) in accordance with the inventive concepts disclosed herein.
Figure 7:
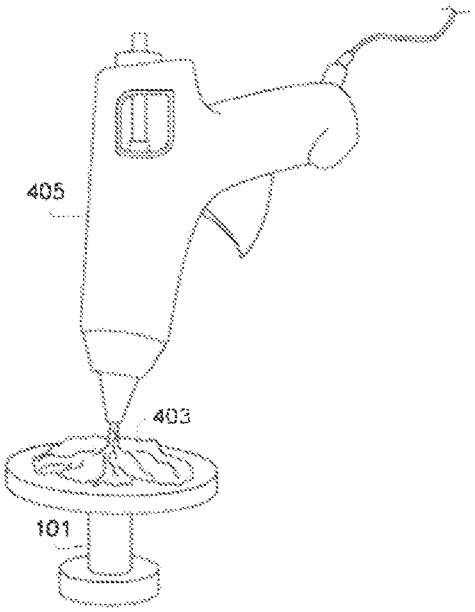
FIG. 7 is a perspective view of a glue tab (101) in accordance with the inventive concepts disclosed herein.
Figure 8:
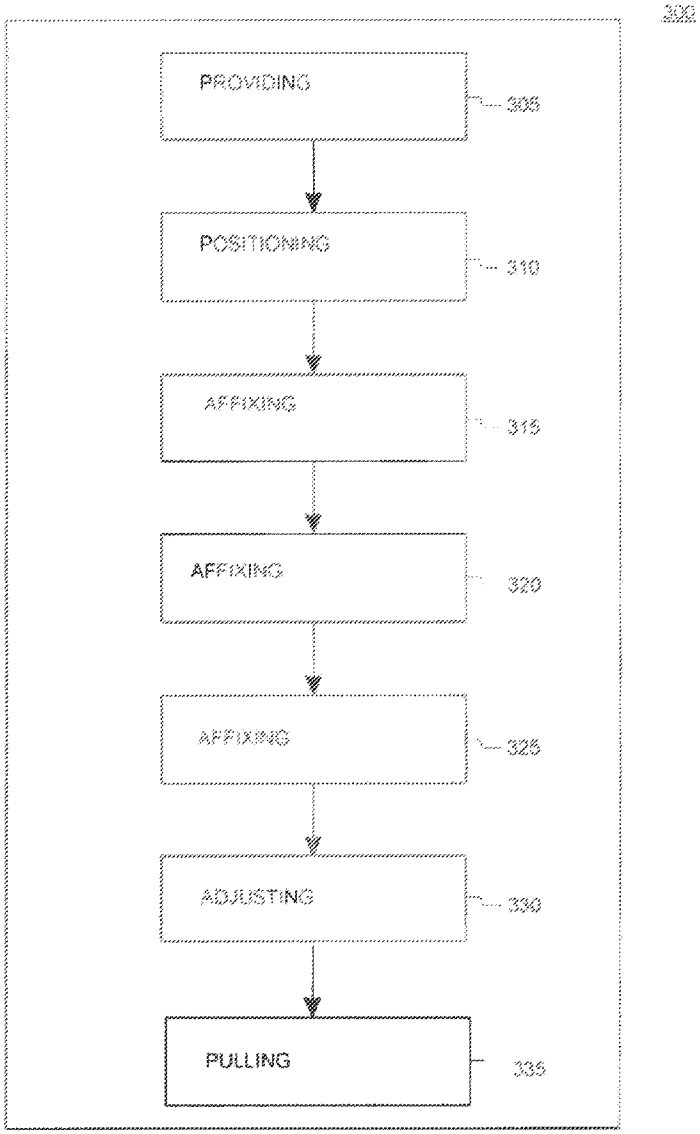
FIG. 8 depicts a method (300) of removing a dent from a vehicle in accordance with the inventive concepts disclosed herein.

Referring now to FIGS. 1-8, shown therein is a paintless dent removal tool (100) for removing a dent from a vehicle and method (300) of removing a dent from a vehicle in accordance with the inventive concepts disclosed herein. FIG. 1 is a perspective view of a side of the paintless dent removal tool (100) in accordance with the inventive concepts disclosed herein. FIG. 2 is a perspective view of an opposite side of the paintless dent removal tool (100) in accordance with the inventive concepts disclosed herein. FIG. 3 is a top perspective view of the paintless dent removal tool (100) in accordance with the inventive concepts disclosed herein. FIG. 4 is a perspective view of a glue tab (such as glue tab 101, 102, or 103) in accordance with the inventive concepts disclosed herein. FIGS. 5-7 depict glue tab (101) being used in accordance with the inventive concepts disclosed herein. FIG. 8 depicts a method (300) of removing a dent from a vehicle in accordance with the inventive concepts disclosed herein.

As shown therein, the paintless dent removal tool (100) includes a hand-held jack member (120) having a grip mechanism (125), a sleeve member (130), a rod member (140), a slide bar (150), a first tension adjustment knob member (160), a second tension adjustment knob member (170), a first foot member (180), and a second foot member (190). In use, the first tension reduction knob member (160) and the second tension reduction knob member (170) are manually adjusted to pull the first foot member (180) and the second foot member (190) outward, thereby reducing tension on the surface of the vehicle surrounding the area of the dent. Simultaneously, the grip mechanism (125) is pulled by a user to manually raise the rod member (140) upward to pull out and remove the dent on the vehicle surface.

The paintless dent removal tool (100) is shown as having a generally rectangular plus "+" shape. It should be understood, however, that the paintless dent removal tool (100) may have any desired shape, including but not limited to, a generally triangular, square, or circular shape for example. Further, each component of the paintless dent removal tool (100) may have the same or different shape, including, but not limited to a rectangular plus "+" shape, a triangular, or circular shape for example.

The paintless dent removal tool (100) may be constructed from any material or combination of materials which are of sufficient strength to maintain the structural integrity of the paintless dent removal tool (100) when in use. For example, the paintless dent removal tool (100) may be constructed in whole or in part from metals and alloys including steel, titanium, iron, combinations thereof and the like, and from plastics, polymers and composite materials, including but not limited to carbon fiber, polycarbonate, impact resistant nylon, resins, ceramics, and the like. Further, it should be understood that, the various components of the paintless dent removal tool (100) may each be constructed from the same or different materials, combinations thereof and the like.

It should be understood that, the various parts of the paintless dent removal tool (100) may be combined, detached, attached, and interchangeably connected and disconnected using a variety of connections known in the art. For example, the various components of the paintless dent removal tool (100) may be detachably connected to one another using, sing, screws, bolts, threads, pins, clips, and other connection mechanisms known in the art.

The detachably removable hand-held jack member (120) includes a top (121), a bottom (122), an internal chamber (123), a rotation mechanism (124), and a grip mechanism (125) for manual operation of the jack member (120). As discussed above, the hand-held jack member (120) may be constructed from any material of sufficient strength to maintain the structural integrity of the paintless dent removal tool (100) when in use. Further, the hand-held jack member (120) may be configured in any desired shape, including but not limited to a generally rectangular, circular, or triangular shape, for example. Further, each component of the hand-held jack member (120) may have the same or different shape, including, but not limited to a rectangular, circular, or triangular shape for example.

The hand-held jack member (120) is a mechanical lifting device used to apply greater force to the surface of a vehicle to pull up and out dents in the surface of a vehicle as described and claimed herein. The hand-held jack member (120) is configured to be manually operated using the grip mechanism (125) such that a user may squeeze the grip mechanism (125) to lift the rod member (140) upward. It should be understood, that any mechanical grip mechanism sufficient to operate the hand-held jack member (120) may be utilized, including for example, an automatic lifting mechanism or manual lifting mechanism including but not limited to hydraulics, electrical power, and the like. The internal chamber (123) of the hand-held jack member (120) is configured for receiving a portion of the rod member (140). Further, the rotation mechanism (124) is positioned such that the hand-held jack member (120) is capable of rotating about the top of the sleeve member (130) so that the grip mechanism (125) may be adjusted in any position to provide maximum comfort and usability for different sized and shaped dents positioned in a variety of different places on the surface of a vehicle. In this way, the paintless dent removal tool (100) may be used to remove a variety of different sized and shaped dents and in a variety of different locations on the surface of a vehicle.

The detachably removable sleeve member (130) includes a top (131), a bottom (132), a rotation mechanism (133), an opening (134), and an internal chamber (135). The top (131) of the sleeve member (130) is configured to be detachably connected to the bottom (122) of the jack member (120) such that the jack member (120) is capable of rotating about the sleeve member (130). As discussed above, the sleeve member (130) may be constructed from any material of sufficient strength to maintain the structural integrity of the paintless dent removal tool (100) when in use. Further, the sleeve member (130) may be configured in any desired shape, including but not limited to a generally rectangular, circular, or triangular shape, for example. Further, each component of the sleeve member (130) may have the same or different shape, including, but not limited to a rectangular, circular, or triangular shape for example.

The sleeve member (130) is configured to be detachably connected to the jack member (120) and to the slide bar (150). The sleeve member (130) is configured to receive the rod member (140) and to be slidable along the length of the slide bar (150) so that the rod member (140) may be positioned at any point along the slide bar (150) to provide leverage and support during use.

The detachably removable rod member (140) is positioned within a portion of the internal chamber (123) of the jack member (120) and a portion of the internal chamber (135) of the sleeve member (130) The rod member (140) has a top end (141) detachably connected to the jack member (120) and a bottom end (142) extending out from the bottom (132) of the sleeve member (130), The rod member (140) may be threaded or ridged such that it is capable of being raised and lowered by the hand-held jack member (120). The rod member (140) may be constructed from any material of sufficient strength necessary to maintain the structural integrity of the paintless dent removal tool (100) when in use. For example, the rod member (140) may be constructed from metals and alloys, including steel, titanium, iron, combinations thereof and the like or non-metals such as plastics, polycarbonate, impact resistant nylon, carbon fiber, polymers, resins, ceramics, composite materials and the like.

The detachably removable slide bar (150) has a first end (151), a second end (152), and an opening (153) extending between the first end (151) and the second end (152). The slide bar (150) is slidably connected to the sleeve member (130). The sleeve member (130) is slidable along the slide bar (150) between the first end (151) of the slide bar (150) and the second end (152) of the slide bar (150). The rod member (140) extends through the opening (153) of the slide bar (150). The slide bar (150) may be constructed from any material of sufficient strength to maintain the structural integrity of the paintless dent removal tool (100) when in use. Further, the slide bar (150) may be configured in any desired shape, including but not limited to a generally rectangular, circular, or triangular shape, for example. Further, each component of the slide bar (150) may have the same or different shape, including, but not limited to a rectangular, circular, or triangular shape for example.

The first tension adjustment knob member (160) is detachably connected to the first end (151) of the slide bar (150). The second tension adjustment knob member (170) detachably connected to the second end (152) of the slide bar (150). Both the first tension adjustment knob member (160) and the second tension adjustment knob member (170) are used to adjust the first foot member (180) and the second foot member (190) to remove the tension in the surface of the vehicle surrounding the area of the dent. The first tension adjustment knob member (160) and the second tension adjustment knob member (170) may be constructed from bolts, screws, rods, pins, clips, clasps, and the like sufficient to manually adjust the first foot member (180) and the second foot member (190) during use. The first tension adjustment knob member (160) and the second tension adjustment knob member (170) may be constructed from any material of sufficient strength to be usable to make manual adjustments to the position of the first foot member (180) and the second foot member (190) and to maintain the structural integrity of the paintless dent removal tool (100) during use.

Further, the first tension adjustment knob member (160) and the second tension adjustment knob member (170) may be configured in any desired shape, including having an ergonomic grip or handle for ease of use and including a generally rectangular, circular, square or triangular shape, for example. Further, each component of the first tension adjustment knob member (160) and the second tension adjustment knob member (170) may have the same or different shape, including, but not limited to a rectangular, circular, square or triangular shape for example.

The first foot member (180) has a top (181) and a bottom (182). The top (181) of the first foot member (180) is detachably connected to the first end (151) of the slide bar (150) and to the first tension adjustment knob member (160). Likewise, the second foot member (190) has a top (191) and a bottom (192). The top (191) of the second foot member (190) is detachably connected to the second end (152) of the slide bar (150) and to the second tension adjustment knob member (170). The first foot member (180) and the second foot member (190) may be constructed from any material of sufficient strength necessary to maintain the structural integrity of the paintless dent removal tool (100) when in use. For example, the first foot member (180) and the second foot member (190) may be constructed from non-metals such as plastics, polycarbonate, impact resistant nylon, carbon fiber, polymers, resins, ceramics, composite materials and the like or metals and alloys, including steel, titanium, iron, combinations thereof and the like. Further, it should be understood that various components of the first foot member (180) and the second foot member (190) may each be constructed from the same or different materials, combinations thereof and the like for example.

The first tension reduction knob member (160) and the second tension reduction knob member (170) are configured to be manually adjusted to pull the first foot member (180) and the second foot member (190) outward. Thereby reducing tension on the surface of the vehicle surrounding the area of the dent. Simultaneously the grip mechanism (125) is configured to be pulled to manually raise the rod member (40) upward to pull out and remove the dent on the vehicle surface.

In some embodiments, the paintless dent removal tool (100) further includes one or more glue tabs that are affixed to both the surface of the vehicle and to the paintless dent removal tool (100) by means of and adhesive, such as a clear glue that does not leave any residual marks on the vehicle surface. Glue tabs generally have a top member, a neck member and a flexible bottom member. Glue tabs are configured so that the flexible bottom member is affixed to a dent with glue and the top member is pulled upward by a user or machine to pull-out a dent in the vehicle body. Glue tabs are configured in a variety of different shapes and sizes so as to be used to pull out and remove a variety of different sized and shaped dents. Glue tabs may be constructed from any material of sufficient strength necessary to maintain the structural integrity of the paintless dent removal tool (100) when in use.

For example, the glue tabs may be constructed from non-metals such as plastics, polycarbonate, impact resistant nylon, carbon fiber, polymers, resins, ceramics, composite materials and the like or metals and alloys, including steel, titanium, iron, combinations thereof and the like. Further, it should be understood that each glue tab may each be constructed from the same or different materials, combinations thereof and the like for example. A glue tab includes a flexible bottom portion of the glue tab is affixed to a dent with glue (by a glue gun for example) and the top of the glue tab is pulled upward by a user (either by hand or by a machine) to pull-out a dent in the vehicle body.

In some embodiments, the paintless dent removal tool (100) includes a first glue tab (101) detachably connected to the bottom end (142) of the rod member (140) and configured to be attached to the surface of a vehicle. Further, in some embodiments, the paintless dent removal tool (100) includes a second glue tab (102) detachably connected to the bottom (182) of the first foot member (180) and configured to be attached to the surface of the vehicle. Likewise, in some embodiments, the paintless dent removal tool (100), further includes a third glue tab (103) detachably connected to the bottom (192) of the second foot member (190) and configured to be attached to the surface of the vehicle.

In some embodiments, the paintless dent removal tool (100) further includes a tab connector (107) detachably connected to the bottom end (142) of the rod member (140). The tab connector (107) is configured to detachably connect and disconnect to a glue tab. The tab connector (107) is configured to permit a glue tab to connect and disconnect thereto by sliding the top member of the glue tab into the tab connector (107). It should be understood, however, that a glue tab may be connected and disconnected to the tab connector (107) by any means, including but not limited to, screws, bolts, pins, adhesives, locking mechanisms, magnets, combinations thereof and the like for example. Further, the tab connector (107) may be used with tools other than glue tabs that are configured to be affixed to a vehicle surface and pulled upward by a person or machine.

Referring now to FIG. 8, shown therein is a method (300) of removing a dent from a vehicle. The method includes the step of providing (305) a paintless dent removal tool (100) for removing a dent from a vehicle. The paintless dent removal tool (100) including a detachably removable hand-held jack member (120). The jack member (120) having a top (121), a bottom (122), an internal chamber (123), a rotation mechanism (124), and a grip mechanism (125) for manual operation of the jack member (120). The paintless dent removal tool (100) includes a detachably removable sleeve member (130). The sleeve member (130) having a top (131), a bottom (132), a rotation mechanism (133), an opening (134), and an internal chamber (135). The top (131) of the sleeve member (130) detachably connected to the bottom (122) of the jack member (120) such that the jack member (120) is capable of rotating about the sleeve member (130). The paintless dent removal tool (100) includes a detachably removable rod member (140) positioned within a portion of the internal chamber (123) of the jack member (120) and a portion of the internal chamber (135) of the sleeve member (130). The rod member (140) having a top end (141) detachably connected to the jack member (120) and a bottom end (142) extending out from the bottom (132) of the sleeve member (130). The paintless dent removal tool (100) including a detachably removable slide bar (150) having a first end (151), a second end (152), and an opening (153) extending between the first end (151) and the second end (152). The slide bar (150) slidably connected to the sleeve member (130).

Wherein the sleeve member (130) is slidable along the slide bar (150) between the first end (151) of the slide bar (150) and the second end (152) of the slide bar (150). Wherein the rod member (140) extends through the opening (153) of the slide bar (150). The paintless dent removal tool (100) further includes a first tension adjustment knob member (160) detachably connected to the first end (151) of the slide bar (150) and a second tension adjustment knob member (170) detachably connected to the second end (152) of the slide bar (150). The paintless dent removal tool further includes a first foot member (180) having a top (181) and a bottom (182). The top (181) of the first foot member (180) detachably connected to the first end (151) of the slide bar (150) and to the first tension adjustment knob member (160). The paintless dent removal tool (100) further includes a second foot member (190) having a top (191) and a bottom (192). The top (191) of the second foot member (190) detachably connected to the second end (152) of the slide bar (150) and to the second tension adjustment knob member (170).

The method (300) further includes the step of positioning (310) the pointless dent removal tool (100) on the surface of a vehicle such that the dent is positioned between the first foot member (180) and the second foot member (190) and the jack member (120). The sleeve member (130) and rod member (140) are positioned directly above the dent. The method (300) further includes the step of affixing (315) a first glue tab (101) to the bottom end (142) of the rod member (140) and to the surface of the vehicle. The method (300) further includes the step of affixing (320) a second glue tab (102) to the bottom (182) of the first foot member (180) and to the surface of the vehicle. The method (300) further includes the step of affixing (325) a third glue tab (103) to the bottom (192) of the second foot member (190) and to the surface of the vehicle. The method (300) further includes the step of adjusting (330) the first tension reduction knob member (160) and the second tension reduction knob member (170) to pull the first foot member (180) and the second foot member (190) outward. Thereby reducing tension on the surface of the vehicle surrounding the area of the dent. The method (300) further includes the step of pulling (335) the grip mechanism to manually raise the rod member (140) upward to pull out and remove the dent on the vehicle surface.

It is to be appreciated that embodiments of the inventive concepts disclosed herein may be shipped fully or partially assembled, or fully or partially disassembled in the form of a kit, as will be readily appreciated by persons of ordinary skill in the art having the benefit of the instant disclosure.

From the above description, it is clear that the inventive concepts disclosed herein are adapted to carry out the objects and to attain the advantages mentioned herein as well as those inherent in the inventive concepts disclosed herein. While exemplary embodiments of the inventive concepts disclosed herein have been described for purposes of this disclosure, it will be understood that numerous changes may be made which will readily suggest themselves to those skilled in the art and which are accomplished within the broad scope of the inventive concepts disclosed herein and defined by the appended claims.

What is claimed is:

1. A paintless dent removal tool for removing a dent from a vehicle, the paintless dent removal tool comprising:

a detachably removable hand-held jack member, the jack member having a top, a bottom, an internal chamber, a rotation mechanism, and a grip mechanism for manual operation of the jack member;

a detachably removable sleeve member, the sleeve member having a top, a bottom, a rotation mechanism, an opening, and an internal chamber, the top of the sleeve member detachably connected to the bottom of the jack member such that the jack member is capable of rotating about the sleeve member;

a detachably removable rod member positioned within a portion of the internal chamber of the jack member and a portion of the internal chamber of the sleeve member, the rod member having a top end detachably connected to the jack member and a bottom end extending out from the bottom of the sleeve member;

a detachably removable slide bar having a first end, a second end, and an opening extending between the first end and the second end, the slide bar slidably connected to the sleeve member, wherein the sleeve member is slidable along the slide bar between the first end of the slide bar and the second end of the slide bar and wherein the rod member extends through the opening of the slide bar;

a first tension adjustment knob member detachably connected to the first end of the slide bar;

a second tension adjustment knob member detachably connected to the second end of the slide bar;

a first foot member having a top and a bottom, the top of the first foot member detachably connected to the first end of the slide bar and to the first tension adjustment knob member;

a second foot member having a top and a bottom, the top of the second foot member detachably connected to the second end of the slide bar and to the second tension adjustment knob member; and wherein, the first tension reduction knob member and the second tension reduction knob member are configured to be manually adjusted to pull the first foot member and the second foot member outward, thereby reducing tension on the surface of the vehicle surrounding the area of the dent, while simultaneously the grip mechanism is configured to be pulled to manually raise the rod member upward to pull out and remove the dent on the vehicle surface.

2. The paintless dent removal tool of claim 1, further comprising:

a first glue tab detachably connected to the bottom end of the rod member and configured to be attached to the surface of a vehicle.

3. The paintless dent removal tool of claim 1, further comprising:

a second glue tab detachably connected to the bottom of the first foot member and configured to attach to the surface of the vehicle.

4. The paintless dent removal tool of claim 1, further comprising:

a third glue tab detachably connected to the bottom of the second foot member and configured to be attached to the surface of the vehicle.

5. The paintless dent removal tool of claim 1, further comprising a tab connector detachably connected to the bottom end of the rod member.

6. A method of removing a dent from a vehicle, the method comprising the steps of:

providing a paintless dent removal tool for removing a dent from a vehicle, the paintless dent removal tool comprising:

a detachably removable hand-held jack member, the jack member having a top, a bottom, an internal chamber, a rotation mechanism, and a grip mechanism for manual operation of the jack member;

a detachably removable sleeve member, the sleeve member having a top, a bottom, a rotation mechanism, an opening, and an internal chamber, the top of the sleeve member detachably connected to the bottom of the jack member such that the jack member is capable of rotating about the sleeve member;

a detachably removable rod member positioned within a portion of the internal chamber of the jack member and a portion of the internal chamber of the sleeve member, the rod member having a top end detachably connected to the jack member and a bottom end extending out from the bottom of the sleeve member;

a detachably removable slide bar having a first end, a second end, and an opening extending between the first end and the second end, the slide bar slidably connected to the sleeve member, wherein the sleeve member is slidable along the slide bar between the first end of the slide bar and the second end of the slide bar and wherein the rod member extends through the opening of the slide bar;

a first tension adjustment knob member detachably connected to the first end of the slide bar;

a second tension adjustment knob member detachably connected to the second end of the slide bar; and a first foot member having a top and a bottom, the top of the first foot member detachably connected to the first end of the slide bar and to the first tension adjustment knob member;

a second foot member having a top and a bottom, the top of the second foot member detachably connected to the second end of the slide bar and to the second tension adjustment knob member;

positioning the paintless dent removal tool on the surface of a vehicle such that the dent is positioned between the first foot member and the second foot member and the jack member, sleeve member and rod member are positioned directly above the dent;

affixing a first glue tab to the bottom end of the rod member and to the surface of the vehicle;

affixing a second glue tab to the bottom of the first foot member and to the surface of the vehicle;

affixing a third glue tab to the bottom of the second foot member and to the surface of the vehicle;

adjusting the first tension reduction knob member and the second tension reduction knob member to pull the first foot member and the second foot member outward, thereby reducing tension on the surface of the vehicle surrounding the area of the dent; and pulling the grip mechanism to manually raise the rod member upward to pull out and remove the dent on the vehicle surface.

* * * * *